US005102134A

United States Patent [19]

Smyth

[11] Patent Number: 5,102,134

[45] Date of Patent: Apr. 7, 1992

[54] MULTIPLE TIER RANDOM NUMBER GENERATOR

[75] Inventor: Richard E. Smyth, Kyle Bay, Australia

[73] Assignee: Ainsworth Nominees Pty., Ltd., Rosebery, Australia

[21] Appl. No.: 476,048

[22] Filed: Feb. 8, 1990

[51] Int. Cl.[5] ..... A63S 5/04

[52] U.S. Cl. ..... 273/138 A; 273/143 R

[58] Field of Search ..... 273/143 R, 138 A, 138 R; 364/410, 411, 412

[56] References Cited

U.S. PATENT DOCUMENTS

| | | | |
|---|---|---|---|
| 3,918,716 | 7/1973 | Nonaka et al. . | |
| 4,448,419 | 5/1984 | Telnaes | 273/143 R |
| 4,492,379 | 1/1985 | Okada . | |
| 4,527,798 | 7/1985 | Siekierski et al. | 273/86 R |
| 4,573,681 | 3/1986 | Okada | 273/143 R |
| 4,657,256 | 4/1987 | Okada | 273/138 A |
| 4,679,143 | 7/1987 | Hagiwara | 273/138 A |
| 4,711,451 | 7/1986 | Pajak et al. . | |
| 4,772,023 | 3/1986 | Okada . | |
| 4,858,932 | 8/1989 | Keane | 273/143 R |

FOREIGN PATENT DOCUMENTS

| | | |
|---|---|---|
| 280649 | 9/1964 | Australia . |
| 35272/84 | 11/1983 | Australia . |
| 557348 | 4/1984 | Australia . |
| 21918/88 | 9/1987 | Australia . |
| 2201279 | 2/1987 | United Kingdom . |

*Primary Examiner*—Edward M. Coven
*Assistant Examiner*—Jessica J. Harrison
*Attorney, Agent, or Firm*—Armstrong, Nikaido, Marmelstein, Kubovcik and Murray

[57] ABSTRACT

A slot machine is provided in which the symbols or indicia to be displayed are selected by using a random number generating technique to generate a random number for each display position, the random number being selected from a first range of numbers corresponding to the number of display possiblilities for that position. A two step random number selection technique is used wherein the first step comprises selecting a random number from a second range of numbers corresponding to the number of display possibilities for that display position less one, and the second step, which is only invoked in the event that a predetermined one of the numbers in the second range is selected, comprises selecting between that predetermined number and the number in the first range which is excluded from the second range. Accordingly, the probability of occurrence for two of the possible results for the display position is different to that for the remainder of the possible results.

14 Claims, 5 Drawing Sheets

Figure 1:
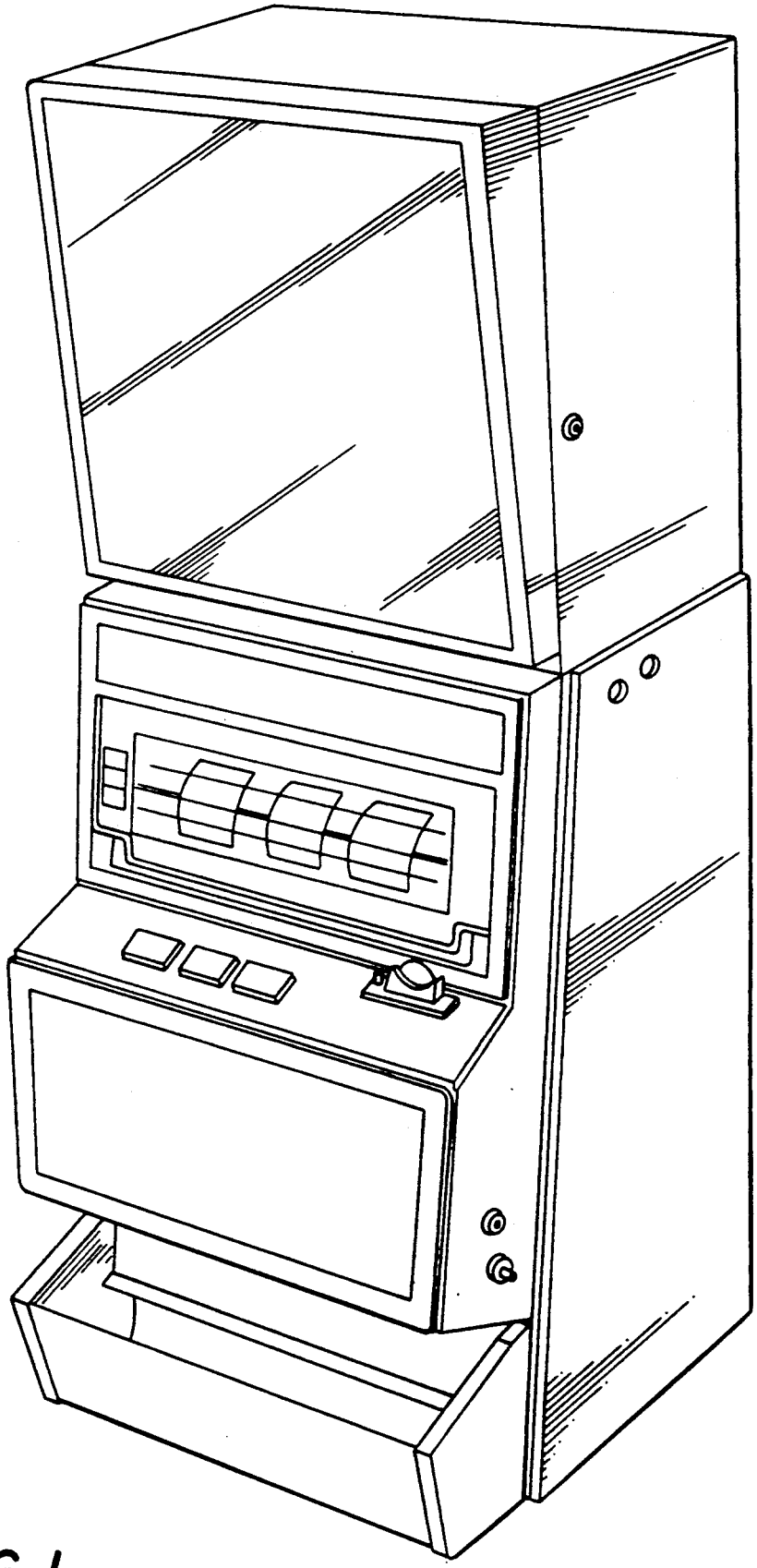

MAPPING FOR REELS 2 AND 3.

20 STOP 3 REELER

MULTIPLE TIER RANDOM NUMBER GENERATOR

The present invention relates generally to slot machines, otherwise known as fruit machines or poker machines, and in particular the invention provides an improved slot machine wherein the probability of winning combinations provided may be altered with regard to conventional machines without changing the number of physical symbols per reel, or alternatively that the number of physical symbols per reel may be decreased, with a consequential increase in symbol size, without altering the probability of winning combinations provided on the machine occurring.

The invention relates to slot machines common to casinos and clubs where the player inserts coins into the machine and spins the reels by handle or button whereupon they become stopped at random and if the stopped symbols coincide with the pay schedule or scorecard the player is paid a prize. If it is a multi-coin machine the player may buy extra chances or multiply potential winnings.

In particular the patent application applies to slot machines with reels, the stopping position of which is random but under the control of a microprocessor; machines of this type are described in British Patent No. 1,550,732 by P.B.R. and U.S. Pat. No. 4,095,795 by Saxton.

In a bid to attract players, casinos have offered higher and higher jackpots and as these are a percentage of revenue the chances of striking a jackpot have to be proportionally less. This was attained in the past by increasing the number of reels and increasing the number of symbols on a reel.

With the development of microprocessor controlled slot machines, where the stopping position of a reel is determined by the microprocessor, a new approach was taken. Telnaes U.S. Pat. No. 4,448,419 selected stopping positions from a virtual reel strip or memory table within the microprocessor which had more virtual positions than there were physical stop positions on the reel itself. By mapping several of these virtual positions to one of the reel symbols, the probability of the reel showing one symbol became different to that for showing others of the symbols. For example, a jackpot symbol can be made to appear with less frequency than other symbols.

With the same intention Bally's Australian Patent No. 33253/89 selects the reel stopping position from a series of random numbers divided into the same number of groups as there are reel positions; however the size of each group is unequal thereby causing the appearance of a jackpot or other symbol to be of unequal probability of appearing on a pay line.

Kabushiki Kaisha Universal also describe an arrangement in their Australian Patent No. 561873 in which the slot machine periodically checks the prize value paid by the machine over the preceding period and if this value is too high, the machine adjusts the operation of the machine to make it harder for the player to win. The Kabushiki Kaisha Universal machine is of the type where the reels are stopped under player control by the player pressing a stop button and winning is made harder by introducing a delay in the reel stopping sequence after the stop button is pressed.

The present invention consists in a slot machine having display means arranged to simultaneously display a plurality of indicia selected from a set of possible indicia and random selection means arranged to select the indicia to be displayed on said display means from said set of indicia, the indicia being divided into two or more subsets and the random selection means including first random number generation means arranged to produce one random number for each indicia display position in the display means, each said random number being selected from members of a set of random numbers each member of which corresponds with either a second or subsequent one of said subsets or one of the indicia in the first subset of indicia, and second random number selection means invoked when a number corresponding to one of said second or subsequent subsets is selected by the first random number generation means, the second random number generation means being arranged to select a number from a set of numbers corresponding to the indicia of the respective second or subsequent subset.

Figure 2:
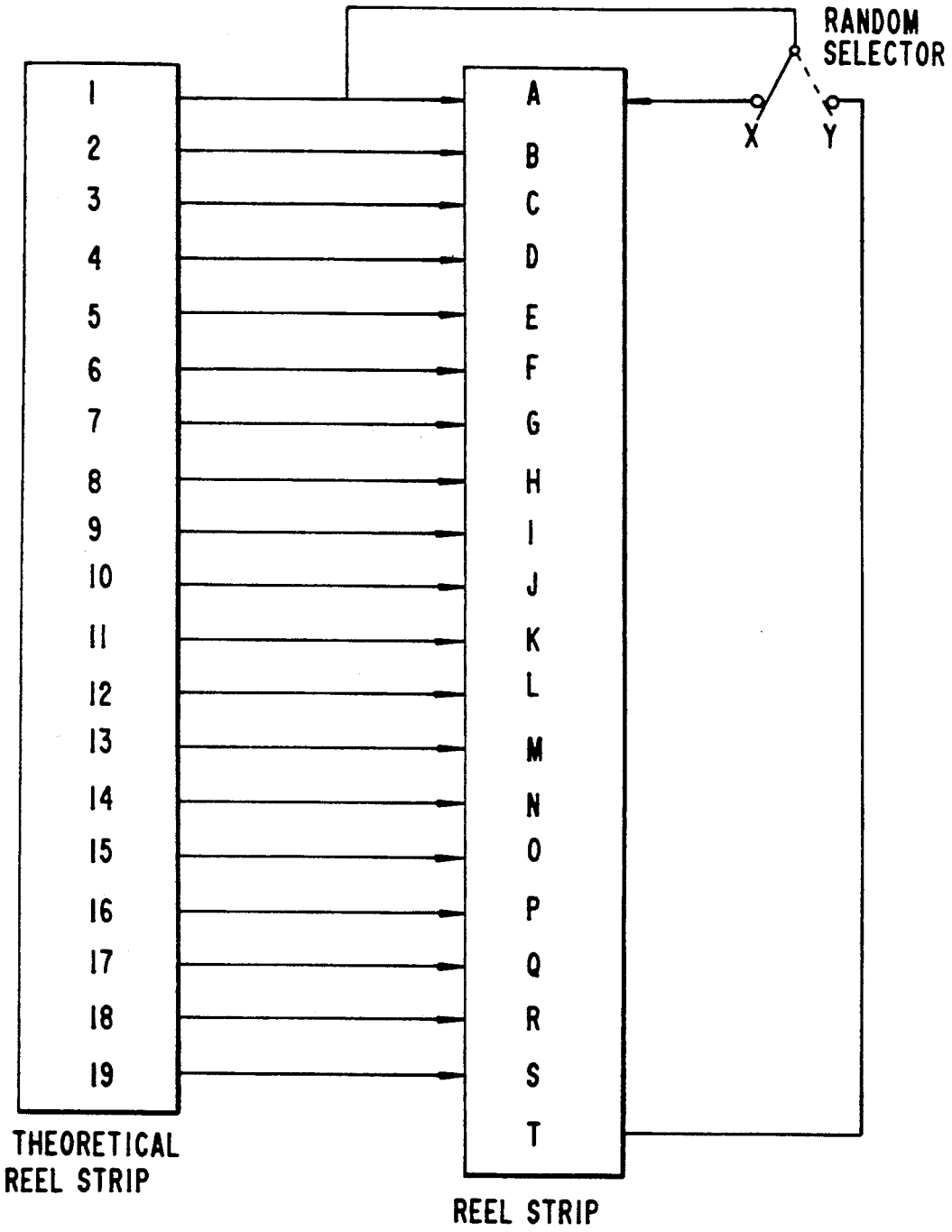
Figure 3:
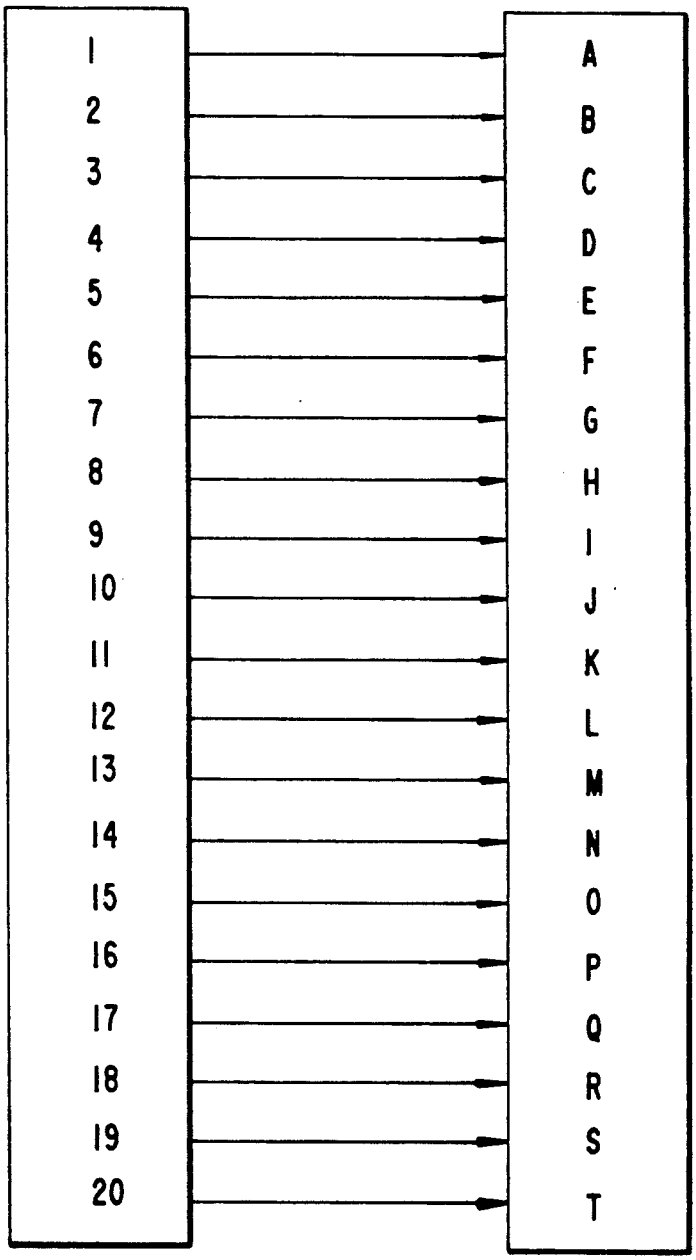
FIG. 3 PRIOR ART
Figure 4:
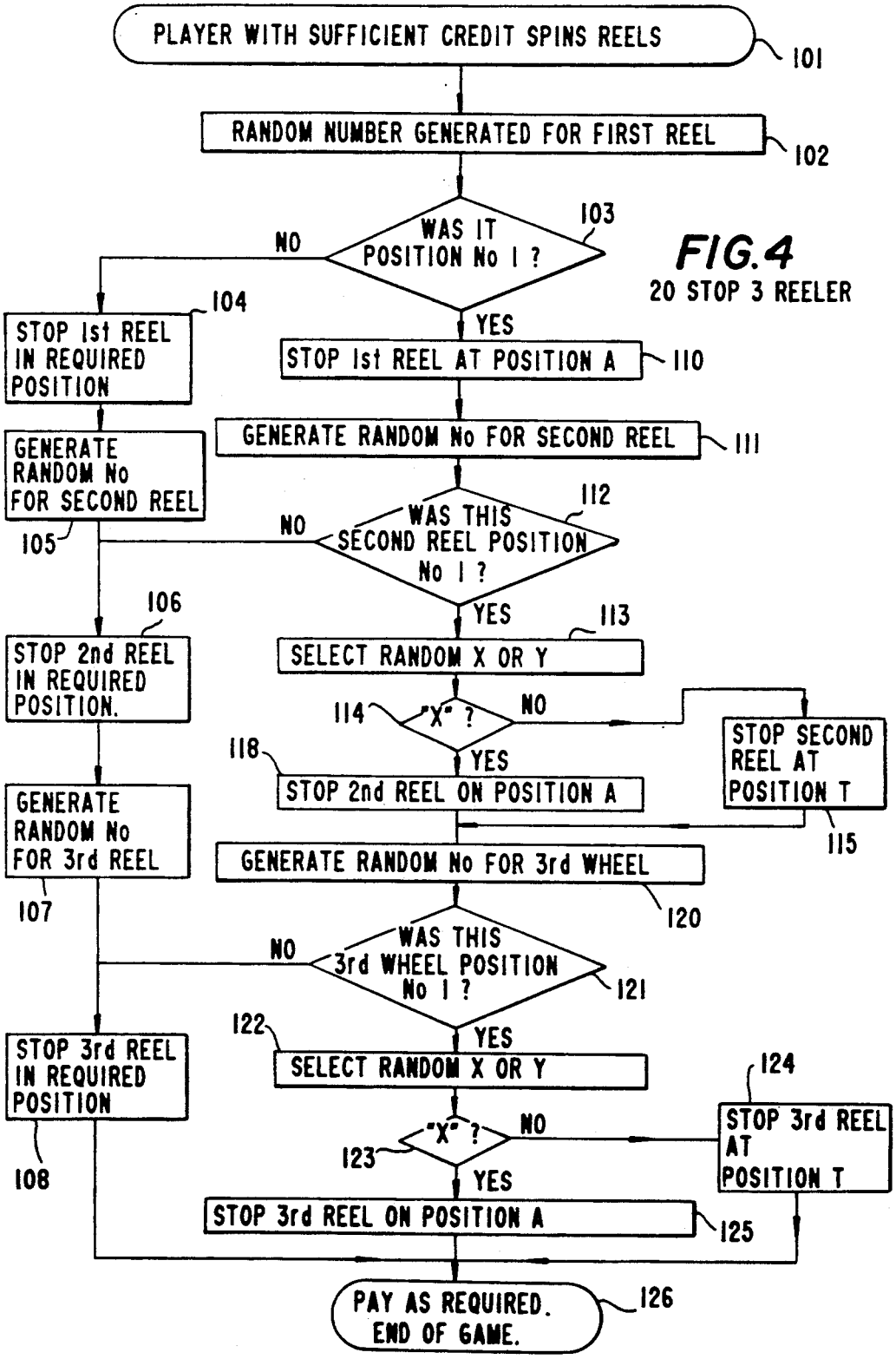
Figure 5:
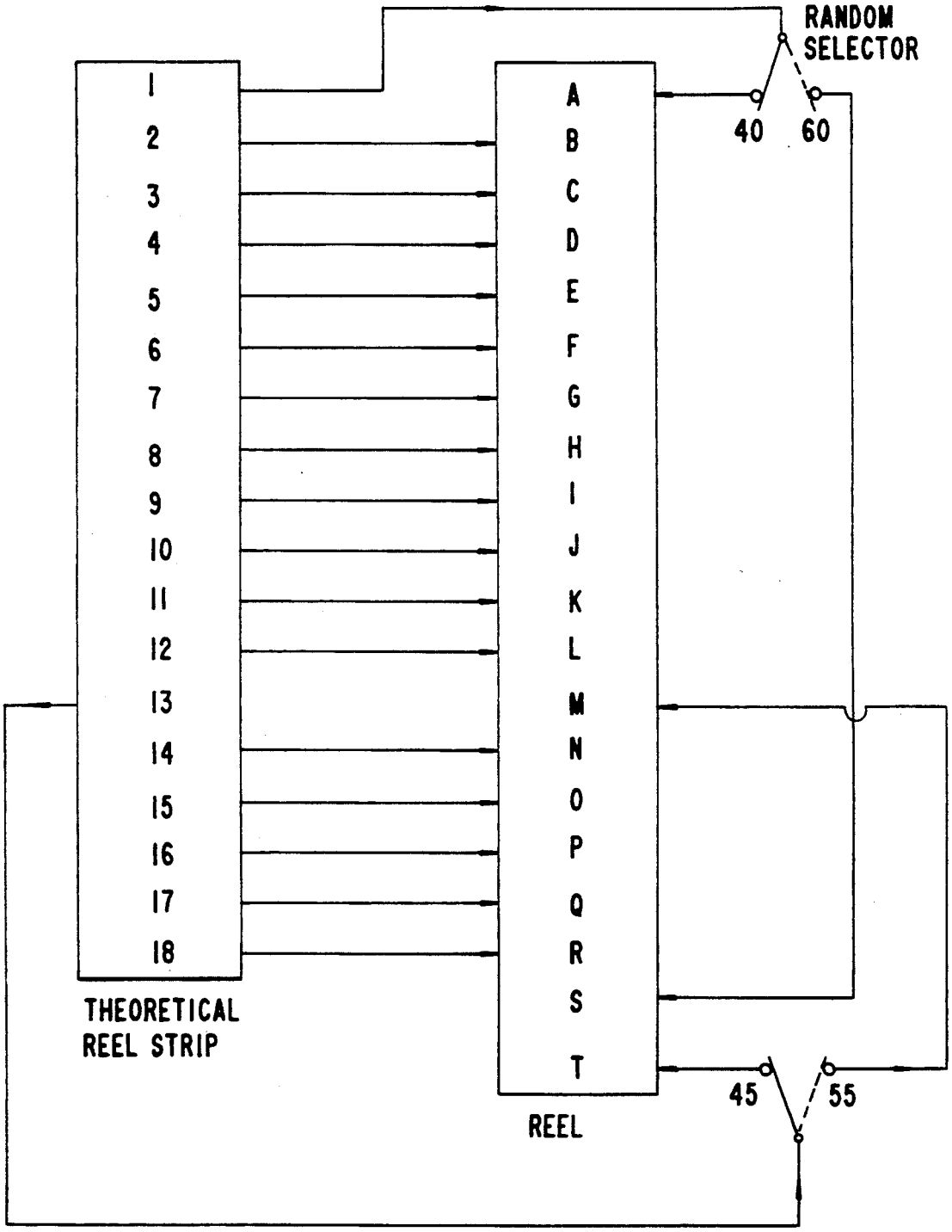

An embodiment of the present invention will now be described by way of example with reference to the accompanying drawings in which:

FIG. 1 illustrates a typical multiline slot machine to which the present invention might be applied;

FIG. 2 schematically illustrates a first reel mapping arrangement in accordance with the present invention;

FIG. 3 schematically illustrates a conventional prior art reel mapping arrangement;

FIG. 4 illustrates a flow chart for reel control in an embodiment of the invention making use of the mapping arrangement of FIG. 2; and FIG. 5 schematically illustrates an alternative reel mapping arrangement to that of FIG. 2.

The basic principle of the present invention is to add a second step or trial when a jackpot symbol position or other nominated symbol position is about to appear on a pay line.

When the stopping of each reel is required, a random number of equal probability is selected by the microprocessor. For all but a jackpot symbol this number is mapped directly to the reel and the microprocessor stops the reel in the required position using a known technique.

In the case where the random number selected corresponds to a jackpot symbol a further random selection process is called up to decide whether the reel is to be stopped on the jackpot or whether the reel is to be stopped instead at a nominated alternative site.

FIG. 2 shows an example of a reel which has 20 stop positions. Position 'A' on the reel or reel strip is a Jackpot and position 'T' is the alternative nominated site.

In this case the range of random numbers which may be selected by the first random number generating means is 1 to 19 and these are shown on the memory table or "theoretical reel strip". When random numbers 2 to 19 are chosen by the microprocessor, these are mapped direct to reel positions as shown.

When random number 1 is chosen, a second, two-position random selector decides whether the reel is to be stopped at position 'A' or whether it is to be stopped at position 'T'.

If only two random numbers are used in the above selector, the chances of position 'A' and position 'T' appearing are equal and each of them will appear with half the probability of symbols 'B' to 'S'; accordingly each could be a jackpot symbol of different kinds.

More flexibility in the planning of pays at the design stage or the ability to make an even higher jackpot can be achieved by a range of random numbers greater than 2 and which can be divided into two groups of unequal size.

For example if 100 random numbers were divided on a 40/60 basis the 20-stop reel would stop at position 'A' with a probability of:

$$\frac{1}{19} \times \frac{40}{100} = (.0211)$$

It would stop at any one of positions 'B' to 'S' with a probability of:

$$\frac{1}{19} = (.0555)$$

It would stop at position 'T' with a probability of:

$$\frac{1}{19} \times \frac{60}{100} = (.0316)$$

To prevent discouraging the player by infrequent appearance of jackpot symbol 'A' or 'T' in the window the preferred embodiment does not apply second tier random selection to the first reel of the slot machine.

For reel one, instead of 19 random numbers, the theoretical reel strip has 20 random numbers, each being mapped to corresponding reel positions 'A' to 'T' as per prior art and as shown in FIG. 3. The remaining reels are operated in accordance with the invention.

To obtain a jackpot, a jackpot symbol is required to stop on the pay line of all reels of the slot machine and if the player fails to achieve this on the first reel to be stopped, there is no point in inhibiting this symbol on the subsequent reels. The player therefore has more encouragement and pleasure than is described in Telnaes 4,448,419 and Bally's 33253/89 where the frequency of jackpot symbols on the payline is always less than for other symbols.

FIG. 4 is a flow chart of the preferred embodiment described above. The left hand path in this flow chart shows the sequence when a jackpot symbol has not occurred on the first reel.

Referring to FIG. 4, the slot machine will enable a player (101) to operate the machine only if the player has established sufficient credit in a conventional manner. Once the player operates the machine, a random number is generated for the first reel (102) and the resulting number is tested (103) to determine if it corresponds to a jackpot symbol or not. If the first random number does not correspond to a jackpot symbol then the reel is stopped (104) and a random number is generated from a set of possible results, equal to the number of symbol positions on the reels, to determine a stopping position for the second reel (105). The second reel is then stopped (106) and a number generated for the third reel (107) and that reel is also stopped (108) in similar fashion. It will be noted that once the possibility of a jackpot is removed, by the jackpot symbol not being selected for the first position, the second and third reels are mapped in the same manner as the first without any provision for two tier symbol selection.

In the event that the jackpot symbol is selected as the stopping position for the first reel, the reel is stopped at position A (110) and a random number is generated (111) for the second reel from a set of possible results which has one less members than the reel has symbols. This number is then tested (112) and in the event that the first position was not selected the reel is stopped (106) and a number selected for the third reel (107) and that reel stopped as previously described for the non-jackpot case.

If position 1 is selected for the second reel by the first random number generation means then a further random selection (113) between two possible results (X or Y) is made and the result tested (114). When a 'Y' result is achieved the second reel is stopped in the T position (115) and a number generated (120) for the third reel.

When an 'X' result is achieved in the second tier selection for the second reel, the reel is stopped in the A or jackpot position (118) and a number is generated for the third reel using a set of possible results having one less members than the reel has symbols (120) as in the corresponding step (111) for the second reel. The selected number is then tested (121) and, if the number is not one, the reel is stopped (108) as per the non-jackpot case. If, however, the first tier selection for the third reel results in the number one being selected, a second tier selection (122) is made in similar manner to the second tier selection (113) for the second reel. The second tier selection is then tested (123) and if a 'Y' result is obtained the third reel is stopped (124) at T. If, on the other hand, the second tier selection for the third reel is 'X', the reel is then stopped at position 'A' (125).

Once all reels are stopped the machine determines if a payout is required and pays (126) accordingly.

It is also possible in another embodiment to accommodate more than two jackpots 'A' and 'T'. FIG. 5 shows one of several possible ways in which, with 18 random numbers on the theoretical reel strip, four different jackpots can be accommodated. Random number 1 on the table can create jackpot 'A' and jackpot 'S' via a second tier selection while random number 13 on the table can create jackpot 'M' and jackpot 'T' via a second tier selection.

I claim:

1. A slot machine comprising control means for controlling operation of the machine, display means including a plurality of display positions for displaying combinations of indicia and reward means for returning a reward to a player of the machine in response to certain predetermined indicia combinations being displayed on the display means at the end of a game, the display means including a separate indicia display means for each display position, each indicia display means being responsive to the control means to display an indicium at the end of the game which is selected by the control means from a set of possible indicia, and the control means including indicia selection means for making that selection for each of the display positions, wherein, for at least one display position, a two tier selection process is employed whereby the set of indicia is divided into at least two non-overlapping subsets and the indicia selection means comprises first random number selection means for selecting a random number from a set of random numbers having members each of which uniquely corresponds to one member of a first of said subsets of the set of indicia plus additional members each of which uniquely corresponds to one of the remaining subsets of indicia, and second random number generation means, which is invoked only in the event of the first random number generation means selecting a number corresponding to one of said remaining subsets, the second random number generation means being arranged to select a number from a set of numbers each of which uniquely corresponds to one indicia in said one of said remaining subsets of indicia, and the display means being arranged to display the indicium corresponding to the number generated by the first random number generation means if the random number selected by the first random number generation means is a number corresponding to a member of said first of said subsets, and being arranged to display the indicium corresponding to the number generated by the second random number generation means, if the number selected by the first random number generation means is a number corresponding to one of the remaining subsets.

2. The slot machine of claim 1, wherein the machine is provided with three display positions and the two tier selection process is employed for the second and third of those positions.

3. The slot machine of claim 1, wherein the set of indicia is divided into two subsets, one containing all but two of the possible indicia for the respective display position and the second subset containing the remaining two indicia.

4. The slot machine of claim 3 wherein the probabilities of selecting one or the other of the indicia in the second subset are not equal.

5. The slot machine of claim 1, wherein the set of indicia is divided into three subsets, one containing all but four of the possible indicia for the respective display position and the second and third subsets each containing two of the remaining four indicia.

6. The slot machine of claim 5, wherein the probabilities of selecting one or the other of the indicia in the second or third subsets respectively are not equal.

7. The slot machine of claim 1, wherein the indicia selection means is arranged to make the selection of an indicium for at least one display position before making the selection for other display positions, and wherein, if the indicium selected for the at least one display position precludes a predetermined combination of indicia occurring on the display means, then the indicia selection means is arranged not to invoke the second random number generating means for the other display positions, but, if the first random number generator means for the other display positions selects a member corresponding to one of the said remaining subsets, to display a predetermined indicium from said remaining subset.

8. The slot machine of claim 7, wherein the indicia selection means is arranged to make the selection of an indicium for each display position sequentially.

9. The slot machine of claim 1, wherein the indicia selection means for at least one display position employs a single tier selection process, the indicia selection means comprising a random number generator for selecting a random number from a set of random numbers having members each of which uniquely correspond to the indicia available for that display, the display means being arranged to display the indicium corresponding to the random number selected.

10. A method of selecting an indicium to be displayed in a slot machine display, the method comprising dividing the set of possible indicia into a plurality of subsets, randomly selecting an element from a set of elements each of which uniquely corresponds to one of the number of indicia in a first of the subsets and the number of remaining subsets, and in the event that the selected element corresponds to one of the remaining subsets further randomly selecting an element from another set of elements corresponding in number to the number of indicia in said one of said remaining subsets and displaying the indicium corresponding to the element selected in said first or second selection.

11. The method of claim 10, wherein the indicia are divided into two subsets, one of which contains all but two of the indicia and the other containing the remaining two indicia.

12. The method of claim 11, wherein, in a further selection, the probabilities of selecting one or the other of the indicia of the second subset are not equal.

13. The method of claim 10, wherein the indicia are divided into three subsets, one of which contains all but four of the indicia and the other two subsets each contain two of the four remaining indicia.

14. The method of claim 13, wherein, in the further selection, the probabilities of selecting one or the other of the indicia of the second or third subset respectively are not equal.

* * * * *